United States Patent [19]

Orndorff, Jr.

[11] 4,036,472

[45] July 19, 1977

[54] PNEUMATIC LIFTING DEVICE

[75] Inventor: Roy Lee Orndorff, Jr., Kent, Ohio

[73] Assignee: The B. F. Goodrich Company, Akron, Ohio

[21] Appl. No.: 740,348

[22] Filed: Nov. 9, 1976

[51] Int. Cl.[2] ..... B66F 3/24

[52] U.S. Cl. ..... 254/93 HP

[58] Field of Search ..... 254/93 HP; 4/185 L

[56] References Cited

U.S. PATENT DOCUMENTS 3,346,885 10/1967 Merriman ..... 4/185 L

FOREIGN PATENT DOCUMENTS 2,269,487 5/1975 France ..... 254/93 HP

*Primary Examiner*—Al Lawrence Smith

*Assistant Examiner*—Robert C. Watson

*Attorney, Agent, or Firm*—Harry F. Pepper, Jr.; W. A. Shira, Jr.

[57] ABSTRACT

A flat, rectangular, inflatable bag type lifting device includes two rectangular walls interconnected at their marginal portions to enclose an inflation chamber or cavity. Each of the two walls have length to width ratios greater than one and include layers of rubberized mutually parallel cords extending at a preselected acute angle relative to the longitudinal center line of the wall in which they are contained with cords of immediately adjacent layers being in opposite directions. When inflated, the bag reduces in length due to the movement of cords to a larger acute angle and thereby achieves a lift height effective for lifting or jacking up structures such as automobiles.

6 Claims, 4 Drawing Figures

PNEUMATIC LIFTING DEVICE

BACKGROUND

The invention relates to lifting devices, such as jacks, and particularly to fluid pressure or pneumatic type lifting devices.

The difficulties, dangers and general inconveniences which are characteristic of mechanical lifting devices or jacks are well known. Many mechanical jacks are multi-component structures which require assembling prior to use. Once in use, the stability of such jacks is often unsatisfactory, requiring the user to take added precautionary measures to guard against the vehicle or other structure being lifted from coming free of contact with and support by the jack. Furthermore, convenient and compact storage of these mechanical jacks is a problem due to their bulk, size and/or weight.

Alleviation of certain of the aforementioned problems attending mechanical jacks has been made possible with fluid pressure or pneumatic type jacks. One of the more commmon forms of pneumatic jacks are the barrel-shaped or cylindrical bag structures which operate on a bellows type principle. These pneumatic jacks, when compared with most known mechanical jacks, offer advantages of an essentially one-piece structure, easy and convenient storage, better stability and lighter weight. One disadvantage of these jacks, has been their high manufacturing cost, a factor believed to have precluded a wider acceptance in the market.

Although efforts have been made to develop pneumatic type jack designs requiring less expensive manufacturing costs, such designs have heretofore been incapable of significantly achieving the advantages over mechanical jacks which are characteristic of the aformentioned cylindrical or bellows-type pneumatic jacks.

SUMMARY

The present invention provides a flat, inflatable, bag type jack comprising upper and lower rectangular walls joined to each other at their side and end margins to enclose an internal inflation chamber or cavity. The upper and lower walls are substantially equal dimensionally and have lengths to width ratios greater than one. Each wall is composed of vulcanized elastomeric material reinforced with an even number of layers of mutually parallel cords extending at a preselected acute angle relative to the wall's longitudinal center line. The selected acute angle is less than 55° and preferably is between about 10° to about 25°. The cords in immediately adjacent layers in a given wall are disposed to extend in opposite directions relative to the longitudinal center line. A strip of square woven fabric is disposed within the widthwise ends of the bag along the end junctures of the upper and lower wall. A valve member is suitably located within the upper wall.

Upon inflation, the cords in each wall member move or "pantograph" to larger angles causing a significant decrease in bag length. This action permits the bag to assume an effective inflated or lifting height and makes available a wider base and contact area than is typically provided by cylindrical or bellows type pneumatic jacks. This wide base and contact area results in improved stability.

BRIEF DESCRIPTION OF THE DRAWINGS

In the drawings which illustrate the invention in accordance with a presently preferred embodiment.

DESCRIPTION OF PRESENTLY PREFERRED EMBODIMENT

Figure 1:
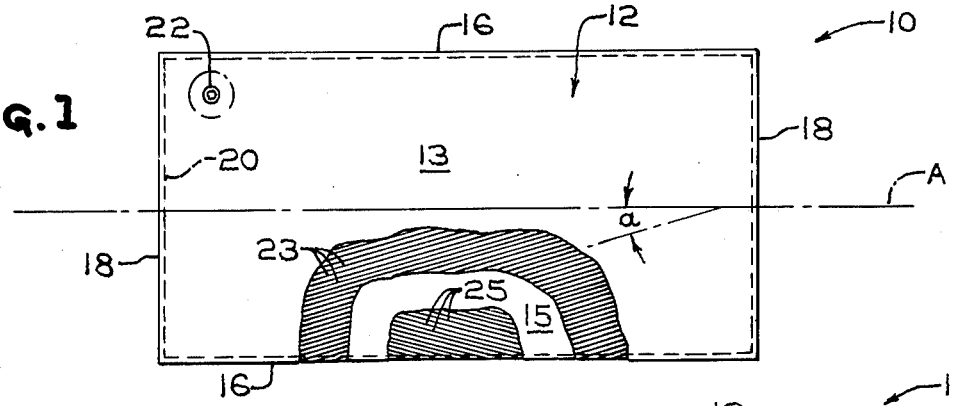
FIG. 1 shows a top view of a flat, inflatable bag-type lifting device, with portions of the upper wall broken away.
Figure 2:
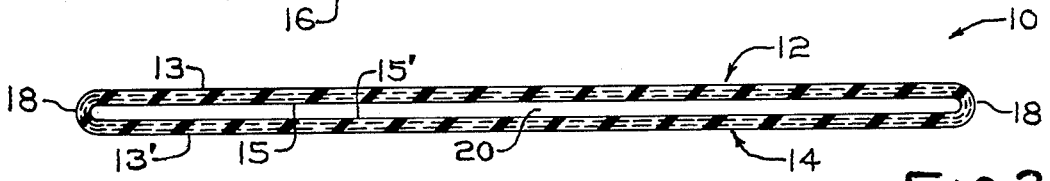
FIG. 2 is an enlarged longitudinal section of the bag shown in FIG. 1.

The inflatable lifting device according to a preferred embodiment of the invention is shown, in a deflated condition, in FIGS. 1 and 2 as a flat bag 10 comprising upper and lower flexible rectangular walls 12 and 14, repectively. Walls 12 and 14 lie closely adjacent each other and are joined at their opposite ends 18 and longitudinal sides 16 to enclose an inner inflation chamber or compartment 20. A valve member 22 is suitably located in the upper wall 12 to provide an inlet and outlet for inflation medium such as air. The upper and lower walls 12 and 14 of the bag are substantially indentical and have a length. (i.e. along sides 16) to width (i.e. along ends 18) ratio greater than 1.

Upper wall 12 comprising two superimposed layers 13 and 15 of cord reinforced elastomeric material. Layer 13 is reinforced by spaced mutually parallel cords 23 disposed to extend at a preselected acute angle a relative to longitudinal center line A of wall 12. Layer 15 is reinforced by spaced mutually parallel cords 25 disposed to also extend at angle a relative to center line A, but in an opposite sense or direction than cords 23 of layer 13.

The cords such as 23 and 25 may be metal, synthetic or natural textiles, or glass. Nylon has been found highly suitable as cord material due to its strength, flexibilty and easy handling. The elastomeric material in which cords 23 and 25 are embedded is preferably a vulcanizable composition of neoprene or other suitable oil and ozone resistant rubber. The angle a at which cords 23 and 25 extend relative to centerline A of wall 13 should be less than 55°and is preferaly between about 10° to about 25°.

Lower wall 14 is constructed similarly to upper wall 12 and comprises layers 13' and 15' of cord reinforced elastomeric material with spaced mutually parallel cords in layer 13' and 15' extending at equal but opposite preselected acute angles a relative to the longitudinal centerline of wall 14.

Figure 4:
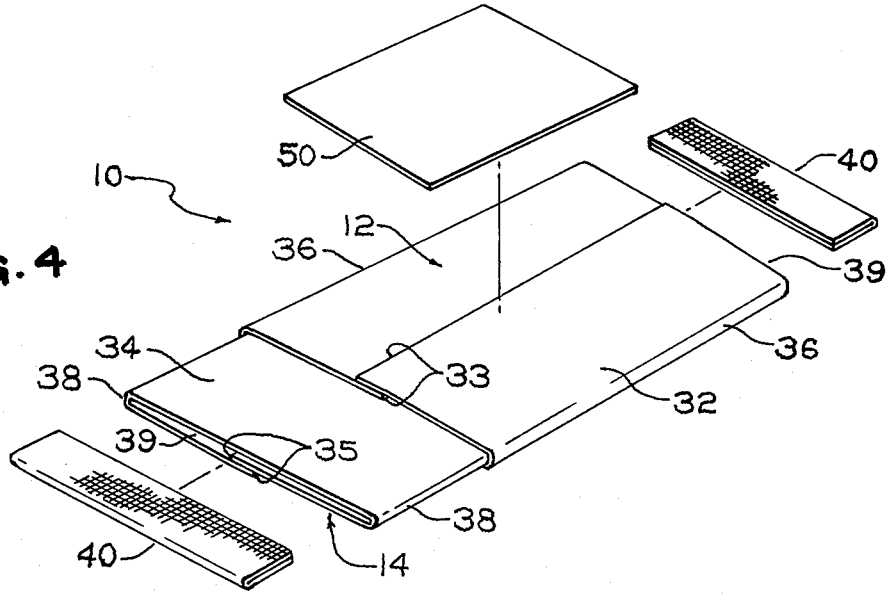
FIG. 4 is another perspective view depicting an arrangement of several basic components which comprise a bag type lifting device according to a preferred form of the present invention.

Further preferred structural details of the bag 10 which are not evident in FIGS. 1 amd 2 are seen in FIG. 4 which illustrates bag 10 broken down as a series of key structural components.

As seen in FIG. 4, bag 10 can be conveniently formed using two sheets of plies 32 and 34 rubberized mutually parallel cords cut on a bias such that the cords will lie at the aforementioned preselected angle a. As shown, the ply 32 is folded to envelop ply 34 which is also folded. The margins 33 of folded ply 32 join substantially along what will be the longitudinal center-line of upper wall 12, while margins 35 of enveloped ply 34 join substantially along what will be the longitudinal center line of bottom wall 14. The folding of plies 32 and 34 is done so that the cords in the respective portions thereof forming walls 12 and 14 are at equal but opposite angles as described previously with regard to FIGS. 1 and 2. It is evident that more than two folded plies such as 32 and 34 can be used to form the rectangular upper and lower walls of bag 10 in the event it is desirable that walls 12 and 14 comprise more than two layers of cord reinforced rubber. In such event, however, it is preferred that the bag be formed so that the upper and lower walls have an even number of such cord layers and that the cords in immediately adjacent layers are oppositely disposed.

As seen in FIG. 4, the adjacent spaced folds 36 and 38 of plies 32 and 34 respectively form the closed longitudinal side margins 16 of bag 10. To form closed end margins 18, a folded strip or tape of rubberized square woven fabric 40 is inserted within each end such as 39 of enveloped folded ply 34, or over or outside each end 39' of enveloping ply 32. Also, if desired two such strips 40 can be placed to form each end margin 18, one strip inside each open end of ply 34 and one strip over or outside of each open end of ply 32.

Preferably, a rubber protective pad 50 is centrally placed over the portion of ply 32 which forms upper wall 12 to provide protection against abrasion, puncture and/or cutting from the vehicle or other object to be lifted by the flat bag. This pad 50 is preferably of the same material as the elastomeric material comprising plies 32 and 34.

Figure 3:
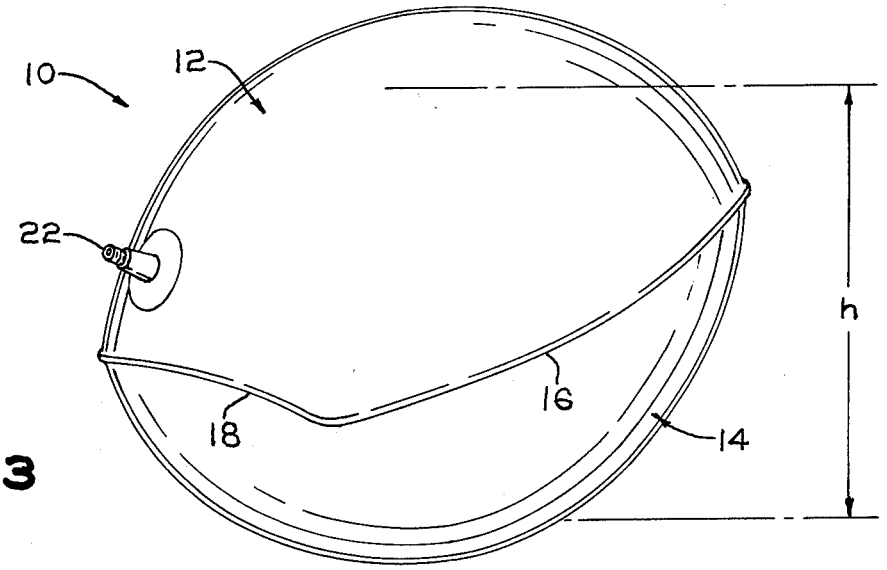
FIG. 3 is a perspective view showing a bag such as shown in FIG. 1 in an inflated condition.

In FIG. 3, bag 10 is shown inflated. During inflation, ends 18 move closer together, effecting an overall decrease in length of the bag when compared to its uninflated length. This action is due to the cords in each wall 12 and 14 moving or "pantographing" to a larger acute angle. The shortened inflated length results in a substantially greater life in height *h* than would occur is there were no reduction in bag length upon inflation due to pantographing cords. The inflated bag 10 as seen by FIG. 3 manifests a broad or wide contact area (i.e. upper wall 12) and base (i.e. lower wall 14) than is typically available in the cylindrical or bellows type pneumatic jacks, a feature which contributes to an overall improved operational stability. When subsequently deflated, the wall cords will pantograph back to substantially their original angle, an action which causes bag 10 to once again return to a flat, wrinkle-free condition.

To demonstrate this phenomenon, a bag such as 10 was built with its upper and lower rectangular walls containing two layers of mutually parallel cords disposed at equal but opposite angles of about 15°. The interior inflation cavity was maintained by using pieces of silicone coated release paper along the inner surfaces of the walls. After the square woven tapes or strips, valve and extra upper wall pad were suitably placed, the assembly was cured to a flat closed bag configuration about 15 in. (38.1 cm) wide and 36 in. (91.44 cm) long. The overall deflated thickness of the bag was about 0.5 in. (1.27 cm). The bag weighed about 6 lbs. (2.72 kg). When inflated, the lift height (unloaded) was about 22 in. (55.9 cm) while the length reduced to about 22 in. (55.9 cm). The cords in the upper and lower walls pantographed to an angle of about 35°. Upon deflation, the bag returned to its original configuration.

It is clear that modifications can be made to the presently preferred embodiment described herein without departing from the scope of the invention as measured by the attached claims.

I claim:

1. A pneumatic lifting device comprising a closed, flat, inflatable bag including upper and lower closely adjacent rectangular walls having length to width ratios greater than one, each of said walls comprising an even number of superimposed layers of rubberized, substantially mutually parallel cords, with the cords in each layer disposed to extend at an acute angle of less than 55° relative to the longitudinal centerline of the wall in which they are contained and in a direction opposite to the cords in an immediately adjacent layer.

2. The lifting device defined in claim 1 further comprising at least one narrow strip of square woven fabric disposed along and joining each pair of widthwise edges of said upper and lower walls.

3. The lifting device defined in claim 1 further comprising a protective pad of elastomeric material superimposed over at least a portion of the uppermost layer of rubberized cords comprising said upper wall.

4. The lifting device defined in claim 1 wherein said angle is between about 10° to about 25°.

5. The lifting device defined in claim 4 further comprising at least one narrow strip of square woven fabric disposed along and joining each pair of widthwise edges of said upper and lower walls.

6. The lifting device defined in claim 4 further comprising a protective pad of elastomeric material superimposed over at least a portion of the uppermost layer of rubbersized cords comprising said upper wall.

* * * * *